United States Patent [19]

Beynet

[11] Patent Number: 4,911,243

[45] Date of Patent: Mar. 27, 1990

[54] METHOD FOR DISCONNECTING A MARINE DRILLING RISER ASSEMBLY

[75] Inventor: Pierre A. Beynet, Tulsa, Okla.

[73] Assignee: Amoco Corporation, Chicago, Ill.

[21] Appl. No.: 219,626

[22] Filed: Jul. 14, 1988

[51] Int. Cl.[4] ..... E21B 43/013

[52] U.S. Cl. ..... 166/340; 166/359; 166/365; 166/377

[58] Field of Search ..... 166/340, 339, 365, 345, 166/359, 335, 368, 324, 316, 377; 285/23, 900, 920

[56] References Cited

U.S. PATENT DOCUMENTS

| | | | |
|---|---|---|---|
| 3,325,190 | 6/1967 | Eckert et al. | 166/340 X |
| 3,452,815 | 7/1969 | Watkins | 285/23 X |
| 3,765,713 | 7/1972 | Watkins | 166/340 |
| 4,343,495 | 8/1982 | Nobilean et al. | 285/23 |
| 4,491,345 | 1/1985 | Regan | 285/920 X |
| 4,621,655 | 11/1986 | Roche | 137/81.2 |
| 4,696,493 | 9/1987 | Brammer | 166/345 X |
| 4,719,937 | 1/1988 | Roche et al. | 166/335 X |

OTHER PUBLICATIONS

Roche, Jr., "Subsea Diverters Handle Shallow Gas Kicks", Ocean Industry, Nov. 1986, pp. 41, 42 and 44.

Erb et al., "Riser Collapse-A Unique Problem in Deep-Water Drilling", IADC/SPE 11394, 1983.

*Primary Examiner*—Hoang C. Dang

*Attorney, Agent, or Firm*—Scott H. Brown; Fred E. Hook

[57] ABSTRACT

Disclosed is a method for disconnecting a marine riser assembly from a subsea wellhead when the marine riser assembly contains substantially gas, the marine riser assembly comprising a riser and a wellhead connector having an internal shoulder for abutting against the top of the subsea wellhead. The method comprises equalizing the pressure acting on the internal shoulder of the wellhead connector and the seawater pressure acting external to the wellhead connector.

2 Claims, 7 Drawing Sheets

METHOD FOR DISCONNECTING A MARINE DRILLING RISER ASSEMBLY

FIELD OF THE INVENTION

The present invention relates to a method for disconnecting a marine riser from a subsea wellhead. More specifically, the present invention relates to a method of disconnecting a marine riser wellhead connector containing substantially gas from a subsea wellhead by balancing the pressures acting internal and external to the wellhead connector.

BACKGROUND OF THE INVENTION

A marine riser is a tubular column used in off-shore drilling operations for oil an gas. It is installed between an underwater well and a floating vessel or semisubmersible facility at the surface of the water. The purpose of the riser is to guide the drillstring to and from the subsea wellhead and to provide means for circulation of drilling fluid. Typically, the marine riser is connected to a subsea wellhead using a wellhead connector. Examples of wellhead connectors are described on pages 1266, 1276, 1277, 1640, and 1642 of the Composite Catalog of Oil Field Equipment and Services, 1984/85 version, Vol. 1. One type of wellhead connector has at the top, a flange for receiving the riser, and at the bottom, locking dogs or securing the wellhead connector to the subsea wellhead. The wellhead connector also includes a sealing element, positioned adjacent the wellhead connector internal shoulder, for preventing the fluid inside the marine riser from leaking out into the surrounding seawater. Once the wellhead connector is operatively secured and sealed to the subsea wellhead, the flow of drilling fluid from the platform through the marine riser and wellhead can begin.

When drilling offshore, unexpected encounter of high pressure gas can result in a well kick that constitutes an emergency. Sometimes the gas kick can be controlled with conventional subsea blowout preventers and pumping kill muds or seawater into the well. Sometimes there is no blowout preventer or the blowout preventer cannot be closed, then the gas kick may be controlled with diverters, as shown in Roche, J. "Subsea Diverters Handle Shallow Gas Kicks." Ocean Industry, (November 1986), pp. 41–44. Oftentimes, the gas kick is so threatening to personnel on the offshore structure that the riser must be disconnected from the subsea wellhead to allow the gas kick to dissipate into the surrounding seawater.

It has been observed that the process of disconnecting a marine wellhead connector from a subsea wellhead becomes increasingly difficult when the wellhead connector and attached riser contains substantially gas rather drilling mud. It has also been observed that riser collapse occurs more frequently when the riser contains substantially gas rather than drilling mud. The disconnection problem has been attributed to mechanical binding of the wellhead connector and the subsea wellhead when the two are not completely aligned. The rise collapse problem has been attribute to the large pressure differential across the riser. See Erb, P.R. "Riser Collapse- A Unique Problem in Deep Water Drilling", IADC/SPE 11394, 1983.

The inventor has determined that the difficulty of disconnect operations experienced when the riser contains substantially gas may also be attributable to a "suction cup" effect occurring at the wellhead connector.

Further, tee inventor has determined that the increase in the frequency of riser collapse may be attributable to weakening of the riser resulting from the increase in tension required to separate the wellhead connector from the subsea wellhead i order to overcome the "suction cup" effect.

The fluid forces acting n the wellhead connector have a direct effect on the ease of separating the wellhead connector from the subsea wellhead during disconnect operations. These fluid forces are directly proportional to the pressures acting internally and externally to the wellhead connector. Thee pressures are described in detail below.

As illustrated in FIG. 1, Pi is the internal riser pressure. It varies depending on the type of fluid contained within the riser, and is related to the hydrostatic head of the fluid in the rise. Initially, Pi is large because the riser is full of drilling mud. When a gas kick is encountered Pi drops significantly. However, Pi will begin rising again when the riser and wellhead connector are disconnected and the seawater enters the riser. Ps is the pressure acting on the internal shoulder of the wellhead connector. When the wellhead connector is locked closed, Ps is equal to the external water pressure Po. However, when the wellhead connector is lifted to a position sufficient to establish fluid communication between the internal shoulder of the wellhead connector and the subsea wellhead, Ps becomes equal to Pi. This occurs because the fluid passage between the inside of the riser and the shoulder is not impaired ,while the passage from the shoulder to the seawater is impaired by locking dogs and the clearance between the wellhead and the connector, see FIG. 5. Ps will begin rising again when the riser and wellhead connector are fully disengaged from the subsea wellhead. Po is the external hydrostatic head f the seawater acting at the wellhead connector, and it is constant.

Ps is proportional to a force lifting the riser, thereby aiding in the disconnect operation, whereas Po is proportional to the force that pushes the riser and wellhead connector toward the subsea wellhead, thereby impeding disconnect operations. When Ps is equal to Po, the pressure forces balance each other and the tension force required to raise the riser is a function of only the weight of the riser in water plus any frictional forces. When Ps is smaller than Po, for example when the riser contains substantially gas and the shoulder of the wellhead connector is in fluid communication with the inside of the riser, the tension force required to raise the riser is greater. This is the "suction cup effect" mentioned earlier. This invention described herein is a solution to the problem of how to offset the increase in tension force required to disconnect the wellhead connector and riser from the subsea wellhead when Ps is substantially smaller than Po.

The increase in tension force required to separate a gas-filled riser from a subsea wellhead is similar to the increase in force required to remove a suction cup from a flat surface after the the suction cup has been depressed. For this reason the phenomenon is referred to as the "suction cup" effect. In the example of the suction cup, the pressure acting to push the suction cup toward the surface is only about 14 lb/sq in., the atmospheric pressure. However, in a subsea environment, the pressure acting to push the riser towards the wellhead can run as high as 1300 lb/sq in. in 3000 feet of water.

During riser disconnect operations, the less tension required to lift he riser the better. The objective is to avoid tension stressing the riser to the point where there is a risk of riser collapse. The risk of riser collapse during riser disconnect operations substantially increases when the riser is gas-filled because the riser is subject to an external hydrostatic pressure larger than the internal hydrostatic pressure. Since greater tension must be applied to lift the gas-filled riser, the risk of riser collapse is increased.

To better understand why a riser filled with gas is more difficult to disconnect than a riser filled with liquid, it is helpful to study the forces acting on a riser full of seawater. When the riser is full of seawater, the pressure on the inside of the riser Pi is the same as the pressure Po on the outside of the riser. After he riser is lifted to a position sufficient to establish fluid communication between the wellhead connector and the subsea wellhead thereby creating a gap, the pressure Ps acting on the internal shoulder of the wellhead connector is equal to Pi; consequently, Ps is equal to Po. Therefore, a balance of fluid forces is achieved and the forces acting on the wellhead connector effectively cancel each other. As a result, the tension force required to separate the wellhead connector and riser from the subsea wellhead can be described by the following equation:

$$T_1 = W_{br} + E \quad (1)$$

where $W_{br}$ is the riser buoyant weight, and E is the frictional force.

In the case where the riser is full of gas, the internal riser pressure Pi is equal to the hydrostatic head of the gas and is substantially less than the external hydrostatic pressure Po of the seawater. When the wellhead connector locking dogs are released and while the seal between the wellhead connector and the subsea wellhead is intact, the force required to lift the riser is:

$$T_2 = T_1 + (Po - Pi)\frac{\pi}{4}(D_s^2 - D_i^2) + E \quad (2)$$

where

Po equals seawater pressure outside the wellhead connector at the level of the sealing element, Pi equals gas pressure at the level of the sealing element;

$D_i$ equals the inside diameter of the riser; and $D_s$ equals the outside diameter of the actual seal.

In general, $T_2$ is not much larger than $T_1$ since typically $D_s$ is slightly larger than $D_i$.

After tension $T_2$ is applied to the riser, the seal between the wellhead connector and the subsea wellhead breaks, and a gap develops between the shoulder of the wellhead connector and the wellhead. Ps becomes approximately equal to the relatively small internal gas pressure Pi, while Po remains the relatively large external hydrostatic pressure of the seawater. This period of unbalanced forces acting on the wellhead connector continues until the gap between the wellhead connector and the subsea wellhead is large enough for a substantial amount of seawater to enter the riser and equalize Po and Ps. This usually occurs after the wellhead connector has been fully disengaged from the subsea wellhead.

In order to achieve the point of disengagement, the tension applied to lift the riser is:

$$T_3 = W_{br} + (Po - Ps)\frac{\pi}{4}(D_d^2 - D_i^2) + E \quad (3)$$

where $D_d$ equals the wellhead connector dogs' inside diameter.

The tension $T_3$ required to lift the riser when the riser is full of gas and the seal between the wellhead connector and the subsea wellhead is broken, is larger than the tension $T_2$ required to lift the riser when the riser is full of gas and the seal is intact. The reason is this seal isolates the internal shoulder of the wellhead connector from the inside of the riser; therefore, Ps is approximately equal to Po when the seal is intact, and Ps is approximately equal to Pi when the seal is broken. The tension required to lift the riser shifts from $T_2$ to $T_3$ immediately after the riser has been lifted to a level sufficient to provide fluid communication between the shoulder of the wellhead connector and the inside of the riser, but not sufficient to allow for fluid communication between the internal shoulder of the wellhead connector and the external seawater. The fluid flow communication between the external seawater Po and the internal shoulder, where Ps is acting, will continue to be impaired by the narrow clearance between the subsea wellhead and the locking dogs until there is complete disengagement of the wellhead connector from the subsea wellhead. Until this occurs, the "suction cup" effect is experienced during disconnect operations.

EXAMPLE 1

The riser is located in 2500 feet of water. The desired effective tension a the bottom is 100 kips. The lower marine riser package weight in water is 200 kips. The riser weight in water and full of water is 67 kips. Assuming the drilling fluid in the riser is seawater, once connected, the riser top tension needed to maintain a minimum of 100 kips effective tension at the bottom is:

$$T_1 = 67 + 100 = 167 \text{ kips}$$

If the lower marine wellhead connector is unlocked, the riser will not disconnect. The top tension has to be increased to 267 kips to lift the riser (67 kips) and the lower marine riser (200 kips) buoyant weight.

EXAMPLE 2

Assume that the initial riser tension is 167 kips as in Example 1, and the same weights. Further, assume that the riser is full of gas vented to the atmosphere.

The lower marine wellhead connector is unlocked. The riser does not disconnect. For the seal to be broken, the tension has to be larger than:

$$T_2 = 267 \text{ kips} + (Po - Pi)\frac{\pi}{4}(D_s^2 - D_i^2) + E$$

Once the seal is broken for disengaging the connector, the tension has to be larger than $$T_3 = 267 \text{ kips} + (Po - Pi)\frac{\pi}{4}(D_d^2 - D_i^2) + E$$

If it is assume that the inside pressure, Pi, is 14 lbs/in.$^2$, and the outside pressure, Po, is equal to 1125 lbs/in.$^2$, which corresponds to 2500 feet of water, the required tension is at least:

$$T_2 = 267 + 85.5 = 352.5 \text{ kips} + E$$

for $D_d = 28.7$ in.

$D_i = 18.75$ in.

$D_s = 21.22$ in.

Then the wellhead connector dogs choke the flow, and to disconnect, T has to be increased to:

$$T_3 = 267 + (P_o - P_i)\frac{\pi}{4}(D_d^2 - D_i)^2 + E$$

Consequently, an overpull of more than 412 kips is required. This increased tension combined with a net external hydrostatic pressure may cause the riser to collapse.

There is a need for a method of disconnecting a gas filled marine riser from a subsea wellhead without having to increase the tension significantly above the tension required to lift the riser if the marine riser was full of drilling fluid.

SUMMARY OF THE INVENTION

The present invention has been contemplated t overcome the foregoing deficiencies and meet the above described needs. Specifically, the present invention is a method for disconnecting a gas-filled marine riser assembly extending from a surface facility to a subsea wellhead, the assembly comprising a marine riser connected to a subsea wellhead utilizing a wellhead connector having an internal shoulder for abutting against the subsea wellhead. The method comprises equalizing the pressure acting on the internal shoulder of the wellhead connector and seawater pressure acting external to the wellhead connector, and disengaging the wellhead connector from the subsea wellhead. The first step is accomplished by either equalizing the internal riser pressure with the seawater pressure acting external to the wellhead connector or equalizing the pressure acting on the internal shoulder of the wellhead connector with the seawater pressure acting external to the wellhead connector. In the former, seawater is routed to the inside of the marine riser through ports in the riser or the wellhead connector. In the latter, a choke is positioned downstream of the internal shoulder of the wellhead connector to apply back pressure to the wellhead connector internal shoulder. The choke can be either an elongated sealing element or bushing disposed between the wellhead connector and the subsea wellhead. The length of the sealing element or bushing must be sufficient to remain alongside the internal shoulder of the subsea wellhead while the wellhead connector is engaged with the subsea wellhead.

DESCRIPTION OF THE PREFERRED EMBODIMENT

The inventor has discovered that the difficulty experienced with marine riser disconnect operations when the riser 1 contains substantially gas can be reduced by equalizing the pressure Ps acting on the internal shoulder 2 of the wellhead connector 6 and the the seawater pressure Po acting external to the wellhead connector 6. This can be accomplished by either of two manners. The first manner is to equalize the internal riser pressure Pi and the hydrostatic head of the seawater Po acting eternal to the wellhead connector 6. This is an indirect way of equalizing Ps and Po because Pi will stay equal to Ps when the wellhead connector 6 is lifted to a position sufficient to establish fluid communication between the wellhead connector internal shoulder 2 and the inside of the riser 1. The second manner is to equalize the pressure Ps acting on the wellhead internal shoulder 2 and the seawater pressure Po acting on external to the wellhead connector 6. This a direct manner of equalizing Ps and Po because Pi is not involved.

Figure 1:
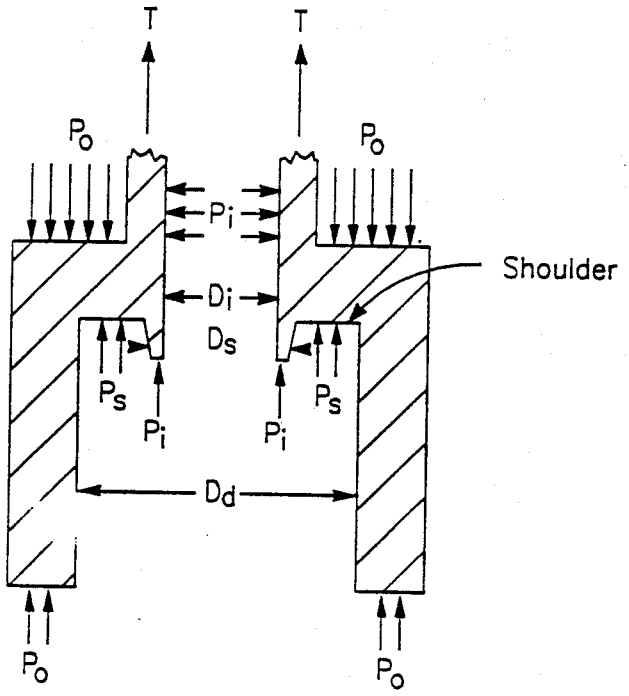
FIG. 1 is a schematic view of a marine wellhead connector showing the pressures acting on the connector.
Figure 2:
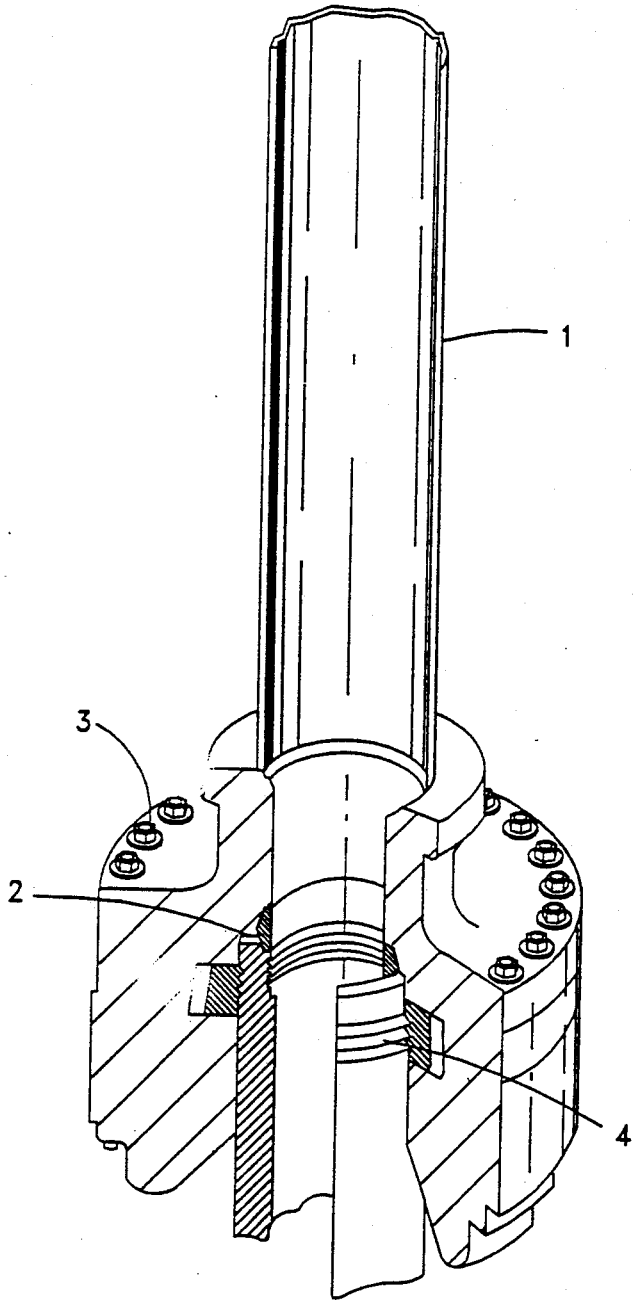
FIG. 2 is a cross-sectional view of a marine wellhead connector fully engaged with a subsea wellhead.
Figure 3:
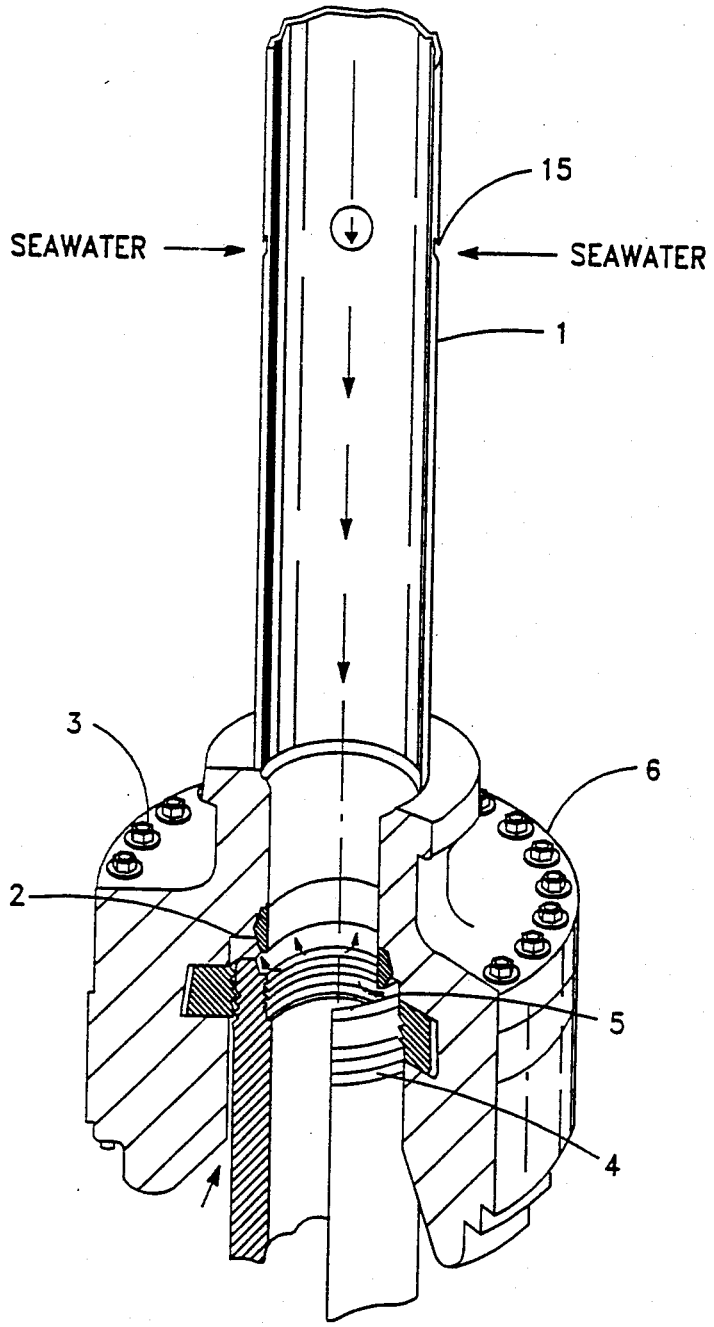
FIG. 3 is a cross-sectional view of a marine riser and wellhead connector positioned above a subsea wellhead wherein seawater enters through ports located in the riser.

In regards to the first manner, one embodiment for equalizing Pi and Po is to route seawater through at least one of the ports 15 located in the marine riser 1 to provide unimpaired fluid communication between inside of the riser 1 and the seawater on the outside of the riser 1. The ports 15, as shown in FIG. 3, can be in the form of a riser fill-up valve as shown in U.S. Pat. No. 4,621,655. This valve responds to the large pressure differential that occurs across the riser 1 when the riser 1 contains gas, and opens to permit seawater to enter the riser 1 and equalize Pi and Po.

Before encountering the gas kick, Ps is approximately equal to Po, and Pi is slightly larger than Po, since the riser contains drilling mud which is normally heavier than seawater. After the gas kick enters the marine riser, Pi drops drastically. However, Ps remains equal to Po until the wellhead connector 6 is lifted to a position sufficient to establish fluid between the internal wellhead connector shoulder 2 and the inside of the riser 1. When this occurs, Ps drops drastically resulting in a pressure imbalance across the wellhead connector 6 and creating a suction-like effect on the marine riser 1. If at this time the wellhead connector 6 is disengaged from the subsea wellhead 4 larger than normal tension must be applied to disengaged the wellhead connector 6 from the subsea wellhead 4. This increased tension coupled with the large pressure differential occurring across the marine riser 1 significantly increases the chance of riser collapse.

This imbalance continues until the ports 15 are opened allowing seawater to enter the marine riser 1 and wellhead connector 6 and equalize the Pi and Po, thereby increasing Ps. By balancing all the forces acting on the wellhead connector 6, the suction-like effect is eliminated. As a result less tension is required to lift the marine riser 1 away from the subsea wellhead 4, thereby reducing the chance of riser collapse during disconnect operations.

The opening of the ports 15 can be wired parallel with the wellhead connector disconnect function so that the port will open when the connector dogs 10 are released, keeping the pressures Po, Pi, and Ps close to each other during the disconnect operation.

Figure 4:
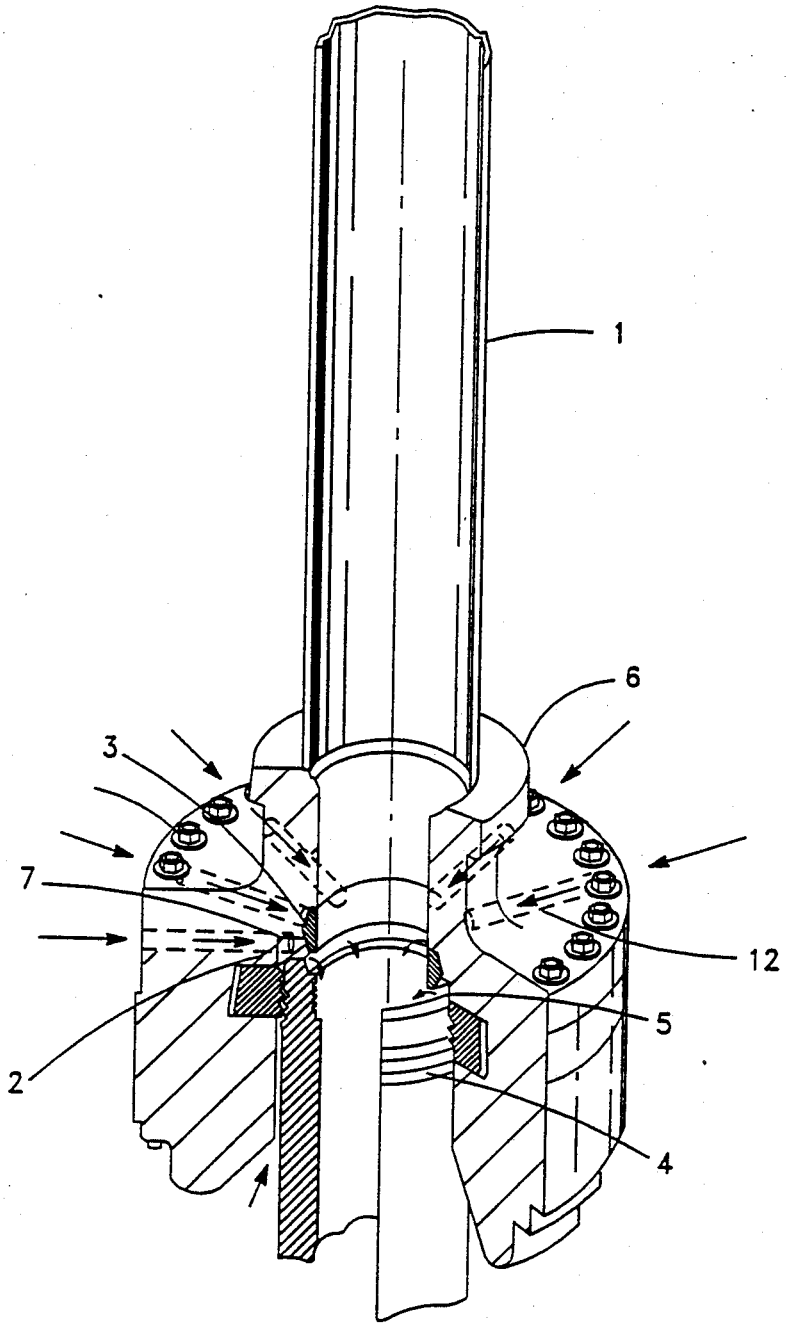
FIG. 4 is a cross-sectional view of a marine riser and wellhead connector positioned above a subsea well wherein seawater enters through ports located in the wellhead connector.

Another embodiment for equalizing Pi and Po is to route seawater through the wellhead connector 6. This can be done by providing at least one opening 12, as shown in FIG. 4, in the wellhead connector 6 such that the seawater enters through the wellhead connector 6. The opening mechanism of the port 12 can be wired such that it opens when the connector dogs are released. The ports 12 in the wellhead connector 6 serve the same purpose as the ports 15 in the marine riser i.e., to eliminate the pressure imbalance occurring across the wellhead connector 6 and marine riser 1 by increasing Pi and Ps to the point where they are the same as Po.

Pi can also be equalized to Po by closing a diverter or blowout preventer positioned above the riser connector 6 to allow the internal gas pressure to build prior to disengaging he wellhead connector 6 from the subsea wellhead 4. However, allowing the pressure to build up in this manner could present a safety hazard.

In regards to the second manner of equalizing Ps and Po, a choke is positioned downstream of the wellhead connector internal shoulder 2 so that such shoulder is on the high pressure side of the choke rather than the low pressure side. Choke is defined as the smallest orifice the seawater flows through on its path from the outside of the wellhead connector 6 around the locking dogs 10 into the marine riser 1. The pressure upstream of the choke is substantially higher than the pressure downstream of the choke due to the the large pressure drop across a relatively small area. The inventor has discovered that by moving the position of the choke relative to the position of wellhead connector shoulder 2 Ps can be maintained about equal to Po while the wellhead connector 6 and the subsea wellhead 4 are still engaged.

Figure 5:
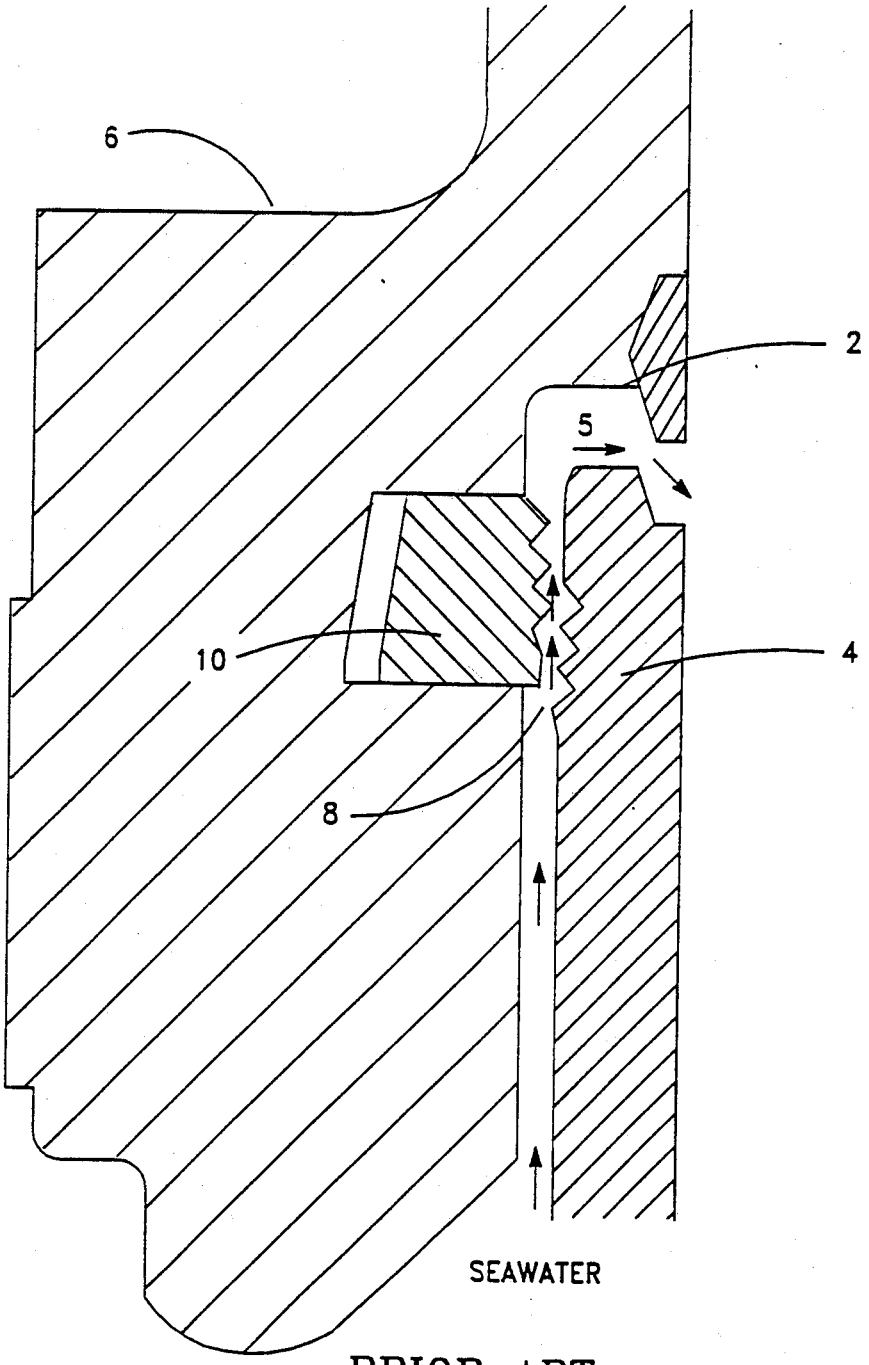
PRIOR ART FIG.5
FIG. 5 is a cross-sectional view of the path seawater takes in route around the wellhead connector to the inside of the marine riser wherein a conventional sealing element is disposed between the wellhead connector and the subsea wellhead.

In a conventional wellhead connector design, as shown in FIG. 5, the choke is the orifice 8 between the released wellhead connector dogs 10 and the external diameter of the subsea wellhead 4. With the choke in this position, the internal wellhead shoulder 2 is downstream of the choke; consequently, it is on the low pressure side of the choke. As a result, Ps is small in comparison to Po. Although there is another orifice 5, the gap between the shoulder 2 and the top of the wellhead 4, it is larger than orifice 8. Therefore, it is not the choke.

The problem with the conventional design is the wellhead connector internal shoulder 2 is downstream of the choke. The solution to this problem is to move the position of the choke, relative to the position of the shoulder 2, so that the wellhead connector shoulder 2 is upstream of the choke and is on the high pressure side of the choke. An equivalent statement of the solution to the problem is to position the choke so that it is downstream of the wellhead connector internal shoulder 2. If this is done, the pressure acting on the shoulder 2 is closer to Po because the choke applies a substantial back pressure to the surface of the shoulder 2.

Figure 6:
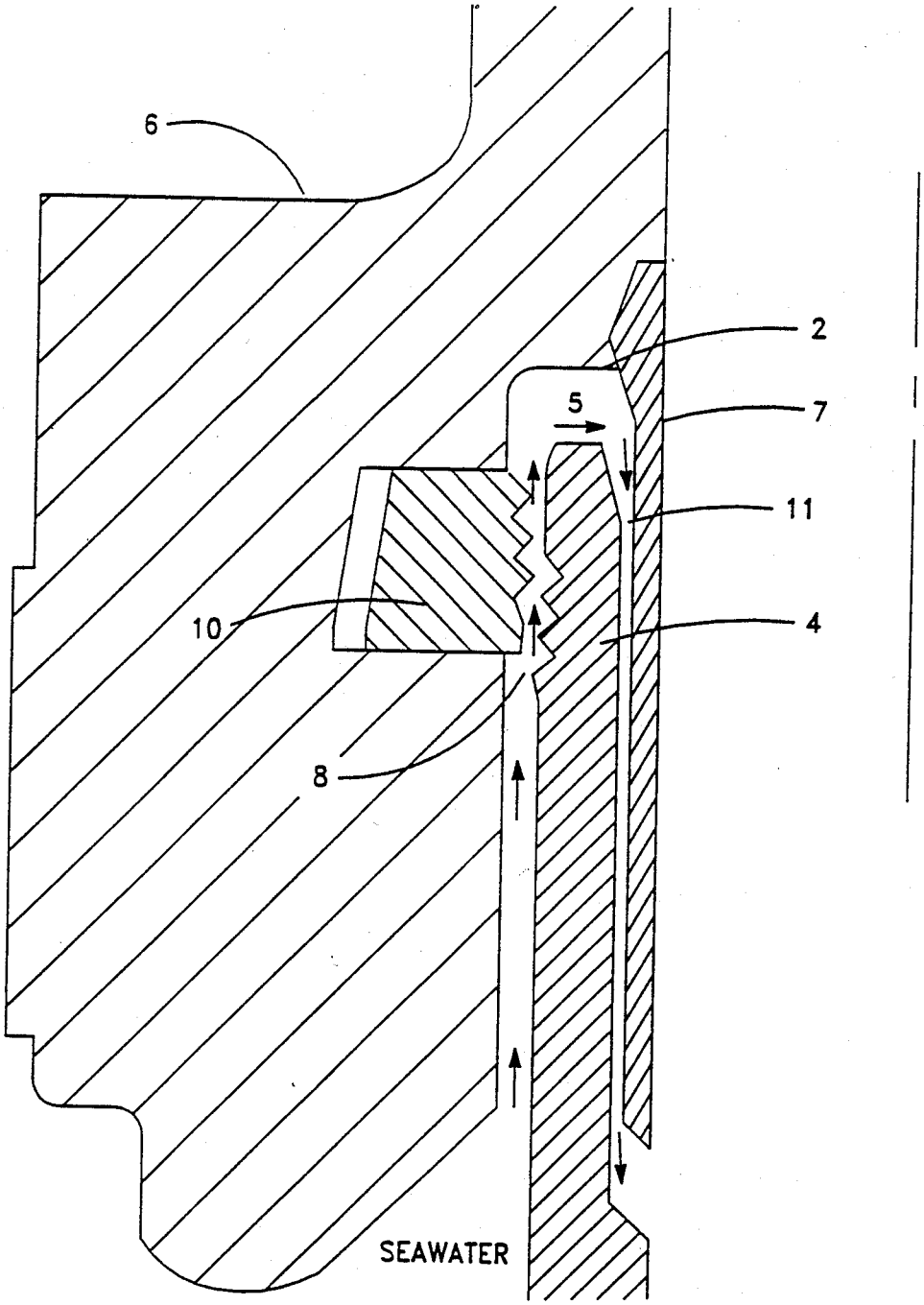
FIG. 6 is a cross-sectional view of the path seawater takes in route around the wellhead connector to the inside of the marine riser wherein an elongated sealing element is disposed between the wellhead connector and the subsea wellhead.

One method for moving the location of the choke so that the shoulder 2 is upstream of the choke is to extend the length of the sealing element 7, as shown in FIG. 6, such that it remains alongside the internal diameter of the subsea wellhead 4 while the wellhead connector 6 is engaged with the subsea wellhead 4. Thus, the smallest orifice the seawater must travel through on its path around the wellhead connector 6 to inside of the marine riser 1 is now the opening 11 between the extended sealing element 7 and the internal diameter of the wellhead 4. With this extended seal, the choke is orifice 11 and not orifice 8; consequently, the wellhead internal shoulder 2 is on the high side of the choke. As a result, Ps is maintained at approximately the same Po. In other words, Ps, which initially is equal to Po, is prevented from effectively communicating with the inside of the riser 1 (where Pi is relatively small in comparison to Po) while the wellhead connector 6 and the subsea wellhead 4 are engaged, thereby maintaining Ps at a relatively high pressure.

The length of tee sealing element 7 required for each wellhead connector 6 will vary. The sealing element 7 should be designed against collapse under outside hydrostatic pressure and also against mechanical jamming during connect or disconnect operations.

Figure 7A:
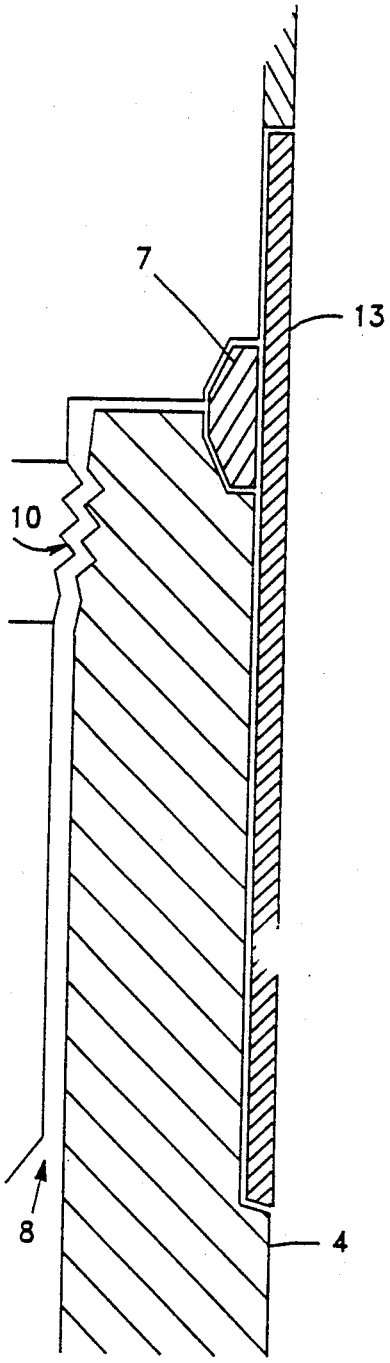
FIG. 7*a* is a cross-sectional view of a marine riser fully engaged with a subsea wellhead wherein a bushing is disposed between the wellhead connector and the subsea wellhead.
Figure 7B:
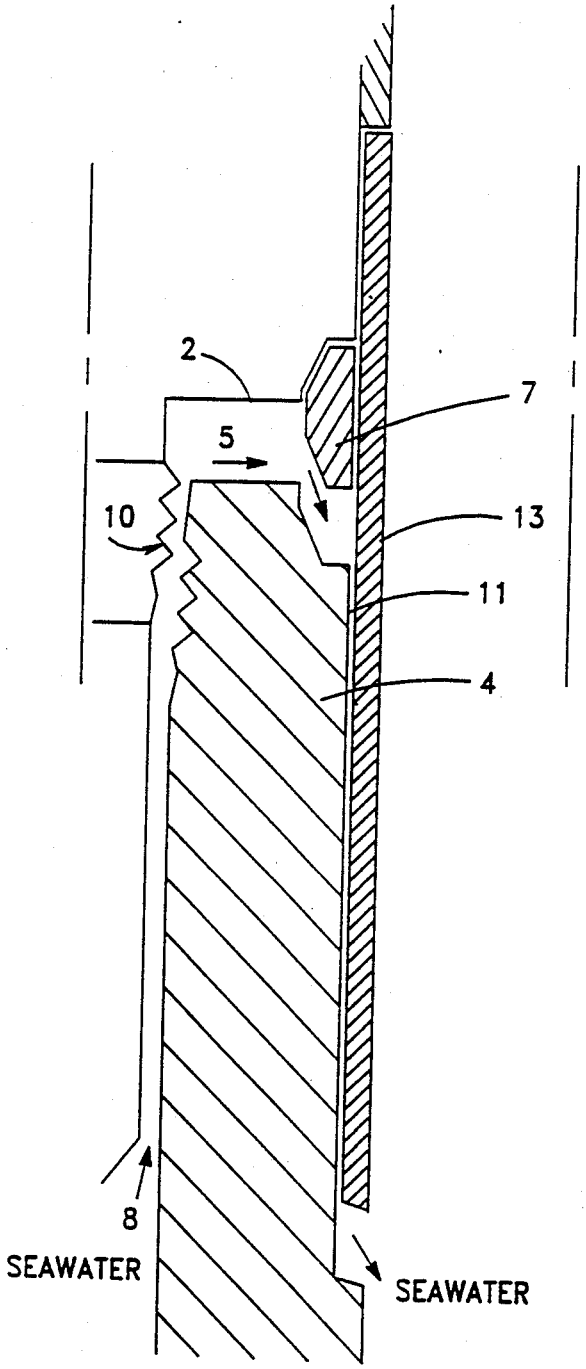
FIG. 7*b* is a cross-sectional view of the path seawater takes in route around the wellhead connector to the inside of the marine riser wherein a bushing is disposed between the wellhead connector and the subsea wellhead.

Another embodiment for ensuring that the choke is downstream of the shoulder 2 is the positioning of a wear bushing 13, as shown in FIGS. 7*a* and 7*b*, between the wellhead connector 6 and the subsea wellhead 4. The bushing 13 serves the same purpose as the elongated sealing element 7 shown in FIG. 6. The purpose being to shift the position of the choke from orifice 8 to orifice 11.

The length of the bushing 13 should be such that it remains alongside the internal diameter of the wellhead 4 for as long as the wellhead connector 6 remains engaged with the wellhead 4.

The method disclosed herein is also applicable to facilitate the disconnect operation of a marine riser and a subsea wellhead when a reverse wellhead connector is used to connect them. In this type of wellhead, the wellhead connector is a male fitting with the locking dogs attached to its pin end and the subsea wellhead is a female fitting with grooves incorporated into the box end.

Various modifications and alterations in the described methods will be apparent to those skilled in the art of the foregoing description which does not depart from the spirit of the invention.

What is claimed is:

1. A method for disconnecting a marine riser assembly extending from a surface facility to a subsea wellhead, the marine riser assembly comprising a marine riser connected to a subsea wellhead utilizing a wellhead connector having an internal shoulder positioned above an upper edge of the subsea well head and having connector dogs for releaseably connecting the wellhead connector to the subsea wellhead, the method comprising:

(a) equalizing pressure acting on the internal shoulder of the wellhead connector and sea water pressure acting externally to the wellhead connector by routing sea water through at least one port located in the marine riser openable in response to movement of the connector dogs to their release positions to provide unimpaired fluid communication between the sea water and the inside of the marine riser; and (b) disengaging the wellhead connector from the subsea wellhead.

2. A method for disconnecting a marine riser assembly extending from a surface facility to a subsea wellhead, the marine riser assembly comprising a marine riser connected to a subsea wellhead utilizing a wellhead connector having an internal shoulder positioned above an upper edge of the subsea wellhead and having connector dogs for releasably connecting the wellhead connector to the subsea wellhead, the method comprising:

(a) equalizing pressure acting on the internal shoulder of the wellhead connector and sea water pressure acting externally to the wellhead connector by routing sea water through at least one port located in the wellhead connector operable in response to movement of the connector dogs to their release position to provide unimpaired fluid communication between the sea water and the inside of the wellhead connector; and (b) disengaging the wellhead connector from the subsea wellhead.

* * * * *

UNITED STATES PATENT AND TRADEMARK OFFICE

CERTIFICATE OF CORRECTION

PATENT NO. : 4,911,243

DATED : March 27, 1990

INVENTOR(S) : Pierre A. Beynet

It is certified that error appears in the above—identified patent and that said Letters Patent is hereby corrected as shown below:

Column 1, line 60, "rise" should read --riser--.

Column 2, line 1, "tee" should read --the--; line 5, "i" should read --in--; line 7, "n" should read --on--; line 12, "Thee" should read --These--; line 18, "rise" should read --riser--; line 37, "f" should read --of--.

Column 3, line 2, "he" should read --the--; line 16, "he" should read --the--.

Column 4, line 33, "a" should read --at--.

Column 5, following line 9, insert --T = 267 + 411 = 678 kips + E--; line 22, "t" should read --to--.

Column 6, line 31, "eternal" should read --external--.

Column 7, line 32, "he" should read --the--.

Column 8, line 25, "tee" should read --the--.

Signed and Sealed this

Twenty-fourth Day of September, 1991

*Attest:*

HARRY F. MANBECK, JR.

*Attesting Officer*

*Commissioner of Patents and Trademarks*